United States Patent [19]

Sable

[11] Patent Number: 4,741,412

[45] Date of Patent: May 3, 1988

[54] ELEVATING DEVICE FOR A WORK VEHICLE

[75] Inventor: Frank R. Sable, Wickliffe, Ohio

[73] Assignee: Caterpillar Industrial Inc., Mentor, Ohio

[21] Appl. No.: 943,358

[22] Filed: Dec. 19, 1986

[51] Int. Cl.[4] ..... B66B 9/20

[52] U.S. Cl. ..... 187/9 R; 269/75; 187/8.69

[58] Field of Search ..... 187/9 R, 8.69, 1 R, 187/95, 8.41, 24, 25, 17, 8.59; 248/288.3; 108/147, 9, 7; 269/75

[56] References Cited

U.S. PATENT DOCUMENTS

| | | | |
|---|---|---|---|
| 659,532 | 10/1900 | Jordan | 269/75 |
| 1,795,072 | 3/1931 | Bosick | 187/24 |
| 2,135,765 | 11/1938 | Paine | 269/75 |
| 2,471,955 | 5/1949 | Hatch | 187/24 |
| 4,102,463 | 7/1978 | Schmidt | 187/9 R |
| 4,374,497 | 2/1983 | Harmand | 108/147 |
| 4,466,509 | 8/1984 | Kishi | 187/18 |

FOREIGN PATENT DOCUMENTS

| | | | |
|---|---|---|---|
| 0102706 | 3/1984 | European Pat. Off. . | |
| 1955837 | 5/1971 | Fed. Rep. of Germany . | |
| 2139667 | 2/1973 | Fed. Rep. of Germany . | |
| 713600 | 10/1931 | France | 187/8.69 |
| 1325390 | 4/1963 | France . | |
| 1533699 | 7/1968 | France . | |

*Primary Examiner*—Joseph J. Rolla
*Assistant Examiner*—Kenneth Noland
*Attorney, Agent, or Firm*—Alan J. Hickman

[57] ABSTRACT

Devices for elevationally moving a platform are complex in construction, bulky, tend to wear prematurely, are unable to maintain the platform at a preselected attitude, and tend to move jerky. A lifting mechanism having an elevationally movable shaft driven by a motor is provided for elevationally moving a platform. A bearing member supports the platform for universal pivotal movement on the shaft, and first and second guide assemblies maintain the platform at a preselected attitude relative to the vehicle frame, guide the platform for substantially straight elevational movement, and prevent undesirable forces from being applied to the shaft. Thus, the problems related to premature wear and failure, jerky operation, platform attitude maintenance, size and complexity are reduced. The elevating device is particularly suited for use on an automatic guided vehicle.

14 Claims, 4 Drawing Sheets

ELEVATING DEVICE FOR A WORK VEHICLE

DESCRIPTION

1. Technical Field

This invention relates to an elevating device for a work vehicle, and more particularly, to an elevating device for an automatic guided material handling vehicle having a platform, a lifting mechanism for elevationally moving the platform, a bearing connected to the lifting mechanism and engageable with the platform, an engaging device for retaining the bearing relative to the platform, and first and second guide assemblies for elevationally guiding the platform.

2. Background of the Invention

Work vehicles frequently employ elevating devices which are capable of supporting and elevationally moving a load. One example of a frame mounted elevating device is shown in U.S. Pat. No. 4,102,463 to Hans Heinrich Schmidt dated July 25, 1978. This patent discloses an elevating device having a load supporting platform carried on a telescopic lifting column which is mounted on the frame of the work vehicle. The telescopic lifting column is sized in transverse cross-section in accordance with the maximum weight to be lifted in order to resist twisting, bending, buckling and the like. Often the transverse cross-sectional dimensions of the lifting column are excessive which makes its use impractical in applications wherein the space available on the vehicle is limited. This is particularly true in applications wherein the load to be carried is in excess of several thousand pounds.

The telescopic lifting column is normally rigidly secured to the platform and the entire weight of the load is supported at the connection between the lifting column and the platform. Bending and twisting load moments of substantial magnitudes act on the connection between the lifting column and platform and frequently cause failure of the connection which renders the elevating device inoperative. As a result of this failure, the vehicle is unable to perform in its usual and customary manner. When such a failure occurs, for example, in material handling and/or manufacturing operations, the entire operation may be shut down until the probelm is corrected. The elevating device therefore must be capable of resisting these bending and twisting load moments applied thereto by the load. Further, the potential of providing a single lifting column elevating device with suitable strength and size for resisting the aforementioned load moments, as well as other loadings, would be impractical.

It is also necessary that the elevating device is capable of resisting rotation so that the platform is maintained at a preselected longitudinal and transverse location relative to the vehicle envelope defined by the vehicle sides. This is particularly important in material handling applications wherein an automatic guided vehicle of the driverless type is utilized. Often a complicated structure such as shown in U.S. Pat. No. 4,466,509 to Mitsuhiro Kishi dated Aug. 21, 1984 is utilized in an attempt to prevent rotary motion. This structure which includes two pairs of spaced apart of supporting beams which are pinned at opposite to the platform and vehicle. Because of heavy loading of the structure in directions transverse to the supporting beams, there is a tendency for premature wear at the pin joints. As a result of this wear, the stability and accuracy of positioning of the platform is less than desirable. This structure is also prone to binding which results in jerky movement of the lifting platform. This motion is entirely unacceptable in automated warehousing and manufacturing operations.

The present invention is directed to overcoming one or more of the problems as set forth above and provide an elevating device that restrains the platform from rotary and pivotal motion, which is compact, and one which eliminates the problems associated with loading of the lifting column in directions other than along the lifting column axis.

DISCLOSURE OF THE INVENTION

In one aspect of the present invention, a work vehicle having a vehicle frame, a platform having opposed load engaging and connecting surfaces, and a lifting mechanism is provided. The lifting mechanism has a housing connected to the frame, a lifting axis, and a shaft movably connected to the housing. The shaft has a first end portion and is movable relative to the housing and along the longitudinal lifting axis between first and second apaced apart positions. A first guide assembly having a guide housing, a guide axis, and a guide rod slidably connected to the guide housing is provided. A first end portion of the guide rod is connected to the connecting surface at a first location on the connecting surface and the guide housing is connected to the frame. A second guide assembly having a guide housing, a guide axis, and a guide rod slidably connected to the second guide assembly housing is also provided. A first end portion of the second guide assembly guide rod is connected to the connecting surface at a second location on the connecting surface spaced from the first location and the first guide assembly housing is connected to the frame. A bearing member having a load bearing portion is connected to the shaft first end portion. The load bearing portion is engaged with the connecting surface at a third location on the connecting surface spaced from said first and second locations and an engaging device is provided for engaging the bearing member and maintaining the bearing member at the third location.

In another aspect of the present invention, an automatic guided vehicle having a frame, a platform having opposed load engaging and connecting surfaces, and a lifting mechanism is provided. The lifting mechanism has a housing, a lifting axis, and a shaft movably connected to the housing. The housing is connected to the frame and the shaft is movable relative to the housing along the lifting axis between first and second apaced apart positions, and a power means is provided for moving the shaft between the first and second spaced apart positions. A first guide assembly has a guide housing connected to the frame, a guide axis, and a guide rod slidably connected to the housing of the first guide assembly. The guide rod has a first end portion and is movable along the guide axis. A first means connects the guide rod first end portion to the platform connecting surface at a first location on the connecting surface. A second guide assembly has a guide housing connected to the frame, a guide axis and a guide rod slidably connected to the second guide assembly housing. The second guide assembly guide rod has a first end portion and is movable along the second guide assembly guide axis. A second means connects the second guide assembly guide rod first end portion to the platform connecting surface at a second location on the connecting surface spaced from the first location. The lifting axis is substantially parallel to the first and second guide assemblies guide axes. A bearing member having a load bearing portion and a retaining portion is connected at the retaining portion to a first end portion of the shaft. The load bearing portion has a spherically crowned surface and is engaged with the connecting surface at a third location on the connecting surface spaced from and between the first and second locations. A shank portion of a connector is secured to the connecting surface adjacent the third location, and a flange portion of the connector is attached to the shank portion and engageable with the bearing member retaining portion.

The lifting mechanism, first and second guide assemblies, bearing member and connector together provide a unique solution to the problems associated with rigidly connecting the lifting mechanism (lift column or shaft) to the platform. By permitting relative pivotal movement between the shaft and platform, the potential for failure is eliminated. Further, since the shaft is not rigidly connected to the platform, forces tending to rotate the platform about the shaft are not transmitted to the shaft. Because the first and second guide assemblies are connected to the platform, the platform is restrained from tipping, cocking, rotating, and the like and maintained at a perselected attitude relative to the vehicle frame. The first and second guide assemblies essentially guide the platform for straight elevational movement and maintains the platform at the preselected attitude throughout its full range of elevational movement. These advantages are accomplished by this structure in a compact, efficient, and economic manner.

BEST MODE FOR CARRYING OUT THE INVENTION

Figure 1:
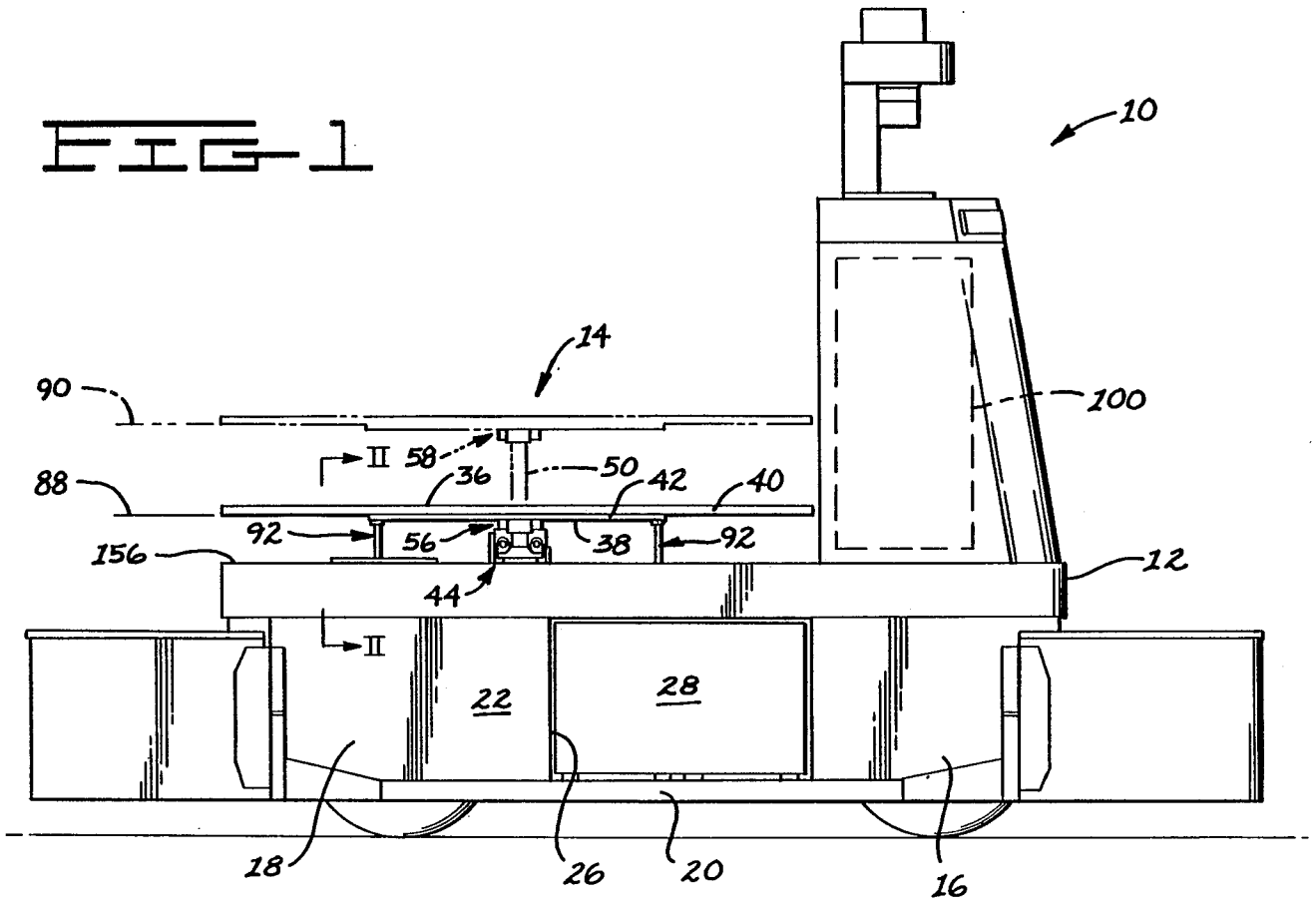
FIG. 1 is a diagrammatic side elevational view of a work vehicle showing the elevating device in a raised position in phantom lines and in a lowered position in solid lines.
Figure 2:
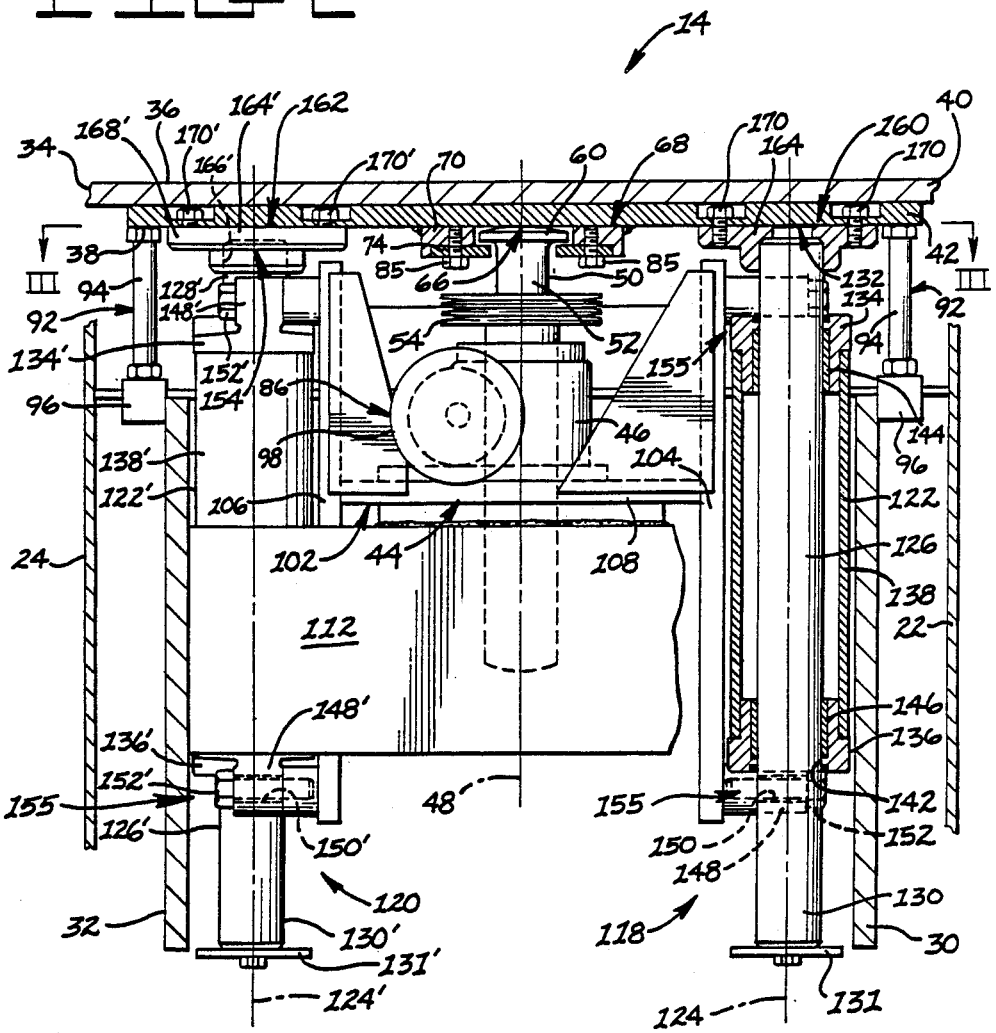
FIG. 2 is a diagrammatic cross-sectional view taken along lines II—II of FIG. 1 with portions broken away, showing the elevating device in greater detail.
Figure 3:
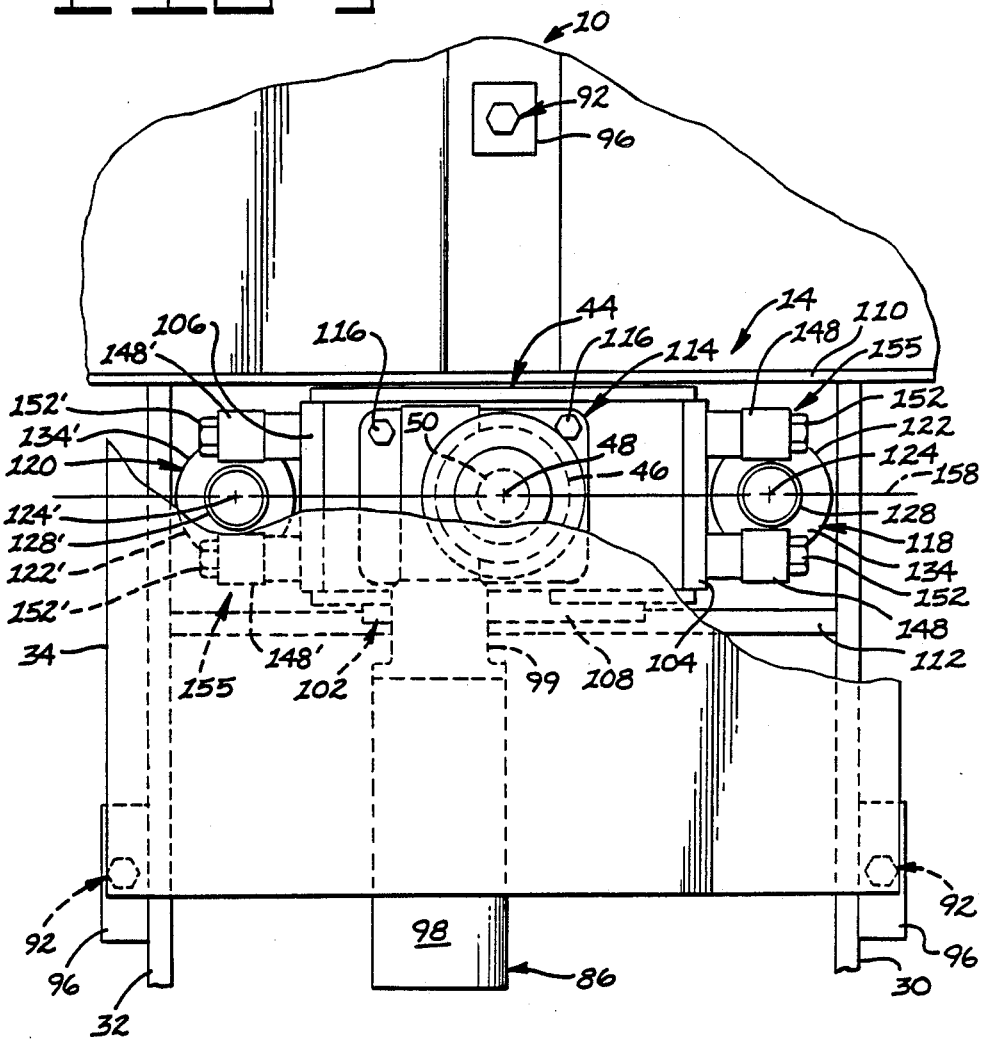
FIG. 3 is a diagrammatic cross-sectional view taken along lines III—III of FIG. 2 with portions broken away, showing the elevating device in yet even greater detail.
Figure 4:
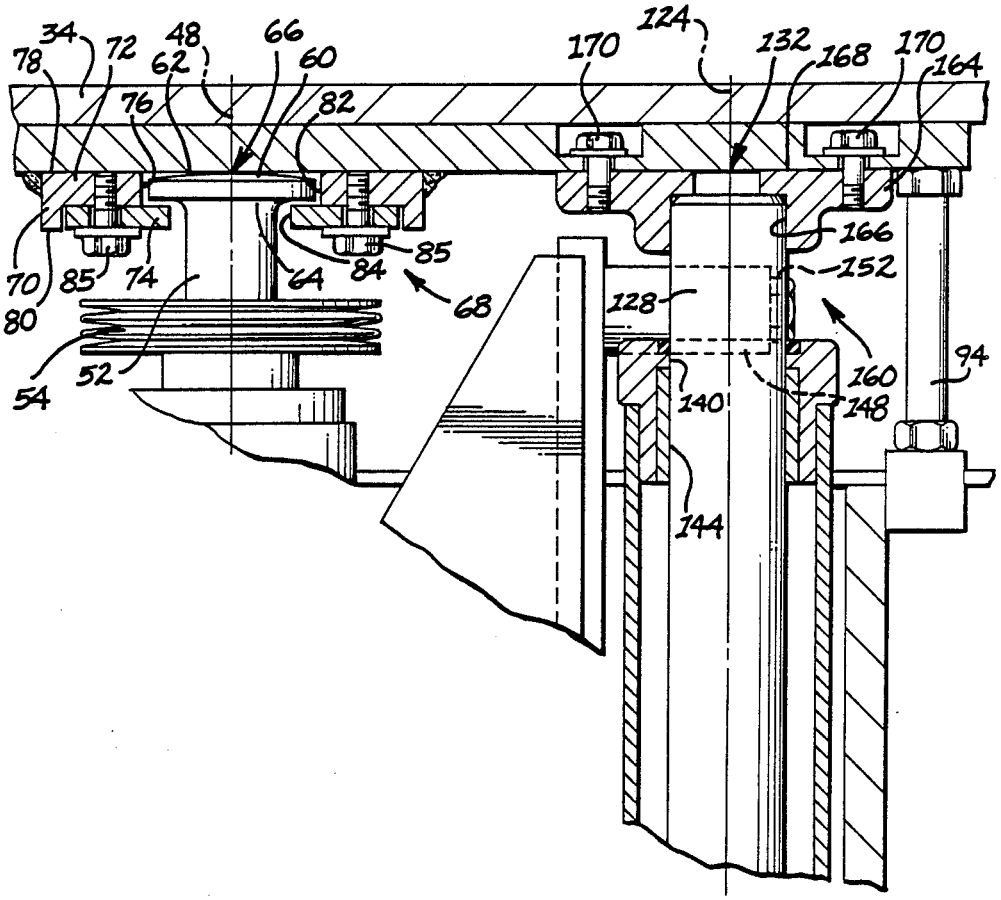
FIG. 4 is a partial diagrammatic view of FIG. 2 showing portions of the elevating device in greater detail.

With reference to the drawings, a work vehicle 10 has a frame 12 and an elevating device 14 connected to the frame 12. The work vehicle 10 is perferably of a type suitable for use in material handling and manufacturing operations and capable of lifting and transporting loads of a wide variety of sizes, shapes, and types. For example, the work vehicle 10 may be an automatic guided vehicle of the driverless free-ranging type which is capable of delivering and acquiring loads in accordance with programmed instructions, a driverless automatic guided vehicle of the conventional wire or stripe guided type, or a driver operated material handling vehicle of a type well-known in the art.

The frame 12 has first and second spaced apart end portions 16,18, a middle portion 20 located between the first and second end portions 16,18, and first and second spaced apart sides 22,24. The middle portion 20 has an opening 26 in the first and second sides 22,24 for receiving a source of motive power, for example, a battery 28, therein. The frame second end portion 18 has first and second spaced apart substantially parallel planar steel support members 30,32. The first and second support members 30,32 are oriented elevationally and extend longitudinally in the direction of movement of the vehicle 10 and longitudinally relative to the vehicle frame 10.

The elevating device 14 has a platform 34 which has opposed load engaging and connecting surfaces 36,38. The load engaging and connecting surfaces 36,38 are preferably planar and parallel to each other. The platform 34 has a substantially rectangular configuration and is positioned at an overlying location above and relative to the second and middle end portions 18,20 of the frame 12 and between the frame first and second sides 22,24. The load engaging surface 36 extends horizontally toward the first and second frame sides 22,24 and is substantially parallel to the surface upon which the vehicle 10 is supported. Preferably, the platform 34 is constructed of first and second steel plates 40,42 connected together in any suitable manner such as by threaded fasteners, welding, and the like (not shown). The first and second steel plates 40,42 have a preselected thickness and strength adequate to support the weight of the load to be carried thereon.

The elevating device 14 has a lifting mechanism 44. The lifting mechanism 44 has a housing 46 which is rigidly secured to the first and second support members 30,32 of the frame 12, a longitudinal lifting axis 48 which extends in an elevational direction substantially normal to the platform connecting surface 38, and a shaft 50 which is movably connected to the housing 46 and extensibly movable relative to the housing 46 in directions along the lifting axis 48. The shaft 50 has a first end portion 52. The first end portion 52 extends from and is external relative to the housing 46. As best seen in FIG. 1, the shaft 50 is movable along the axis 48 between a first position 56 at which the shaft first end portion 52 is adjacent the housing 46 and a second position 58 at which the shaft first end portion 52 is elevationally spaced from the housing 46 and from the first position 56. The shaft 50 is preferably a cylindrically shaped elongated member of a suitable steel material capable of providing adequate compressive and tensile strength to support the force component of the load on the platform 34 acting in a direction along the axis 48. A dust seal 54 in the form of a cylindrical bellows is connected to the shaft first end portion 52 and the housing 46 and prevents dirt from entering the housing 46.

A bearing member 60 having a load bearing portion 62 and a retaining portion 64 is connected at the retaining portion 64 to the first end portion 52 of the shaft 50. The retaining portion 64 faces in a direction toward the shaft 52 and away from the platform 34, and the load bearing portion 62 faces in a direction toward the platform 34 and away from the shaft 50. Thus, the retaining portion 64 faces in a direction opposite the load bearing portion 62. The bearing member 60 is preferably made of steel and either an integral machined portion of the shaft first end portion 52 or fastened to the first end portion 52 of the shaft 50 in any suitable manner, such as by welding. The load bearing portion 62 has a crowned spherically shaped profile and is hardened to resist scoring, galling, and wear. It should be noted that the crowned profile is preferred; however, other shapes capable of permitting pivotal or rolling motion of the load bearing portion 62 relative to the platform 34 would be suitable substitutes. The retaining portion 64 has a substantially planar profile and is suitable for retention purposes. The load bearing portion 62 is engageable with the platform connecting surface 38 at a third location 66 on the platform connecting surface 38 but free from rigid conection therewith to permit the aforementioned pivotal or rolling motion and to eliminate the potential for failure at this juncture. The third location 66 on the connecting surface is preferably hardened to resist scoring, galling, and wear in a manner similar to that of the load bearing portion 62.

A means 68 is provided for engaging the bearing member 60 and maintaining the bearing member 60 at the third location 66 on the connecting surface 38. The engaging means 68 includes a connector 70 which has a shank portion 72 and a flange portion 74. The flange portion 74 is connected to the shank portion 72 and extends from the shank portion 72. The shank portion 72 is connected to the connecting surface 38 at a location adjacent the third location 66 in any suitable manner, such as by welding. The flange portion 74 is positioned to engage the retaining portion 64. The shank portion 72 has a bore 76 opening at first and second ends 78,80 of the shank portion 72 and a counter bore 82 disposed in the shank portion 72 at the second end 82. The bore 76 and counter bore 82 are substantially axially aligned relative to each other and positioned to axially lie along lifting axis 48. The bore 76 is preferably cylindrical in shape and of a diameter sufficient to receive bearing member 60 therein. Counterbore 82 is also preferably cylindrical in shape and of a size and depth to receive the flange portion 74 therein.

The flange portion 74 is an annular ring of a suitable steel material which extends inwardly from the shank portion 72 in a direction toward the rod 50. The flange portion 74 is capable of engaging the retaining portion 64 and preventing the bearing member 60 from exiting the bore 76 at the second end 80 of the shank portion 72. An aperture 84 in flange portion 74 permits the rod 50 to pass therethrough but is of a size insufficient for allowing the bearing member 60 to pass. The flange portion 74 may be a segmented annular ring to permit ease of assembly and disassembly. The flange portion 74 is connected to the shank portion 72 at the second end 80 by a plurality of threaded fasteners 85 screwthreadably engaged with the shank portion 72. The flange portion 74 is piloted in the counterbore 82 and maintained a preselected distance from the load engaging surface 36 in a direction along the lifting axis 48. This preselected distance is a function of the axial distance between the load bearing portion 62 and the retaining portion 64, and the amount of clearance required between the flange portion 74 and the retaining portion 64 necessary to provide for adequate pivotal or rolling motion of the bearing member 60 relative to the connecting surface.

A power means 86 is provided for moving the shaft 50 between the first and second spaced apart positions 56,58. The platform 34 is movable between elevationally spaced apart lowered and raised positions 88,90 (FIG. 1) relative to the frame 12 in response to movement of the shaft 50 between the first and second positions 56,58, respectively. It is to be emphasized that the platform 34 is at the lowered position 88 when the shaft is at the first position 58 and at the raised position 90 when the shaft 50 is at the second position 58. The elevational position of the platform 34 is determined by the extended position of the shaft 50 relative to the housing 46 of the lifting mechanism 44.

A plurality of adjustable stops 92 are connected to the frame 12 at spaced apart locations on the frame and establish the lowered position 88 of the platform 34. The stops 92, shown as a plurality of elongated threaded rods 94 screwthreadably connected to threaded connecting blocks 96 mounted on the frame 12, engage the connecting surface 38 of the platform 34 at the lowered position 88 of the platform 34. The stops 92 not only determine the lowered position 88 of the platform 34 but also carry the weight of the load being supported on the platform 34 when the platform 34 abuts the stops 92. There are preferably at least three stops 92 so that the surface of the platform may be maintained at a preselected attitude (horizontal) relative to the frame 12 at the lowered platform position 88. The stops 92 are of a strength suitable to support the maximum weight of a load to be carried on the vehicle 10.

The power means 86 is connected to the lifting mechanism housing 46 in any suitable and conventional manner and is drivingly connected to shaft 50. The power means 86 preferably includes an electric motor 98 having a rotary output shaft (not shown), and a transmission mechanism 99 of any suitable design capable of converting rotation of the rotary output shaft to linear motion of the shaft 50 is disposed in the lifting mechanism housing 46. The transmission mechanism may utilize gears, friction drive members, pulleys and belts, and a hydraulic pump and motor to achieve the desired motion conversion. Transmissions such as these are well-known in the art and will not be discussed in any greater detail. Electrical energy is delivered from the battery 28 to the electric motor 98 by any suitable electrical circuit (not shown). Preferably, the delivery of electrical current from the battery to the electric motor 98 is controlled by a programmable controller 100 located onboard the vehicle 10. The controller 100 is capable of controlling the direction, speed of movement, and elevational position of shaft 50 relative to frame 12 by controlling the speed and direction of rotation of the rotary output shaft of the electric motor 98 and the length of time of rotation of the rotary output shaft of electric motor 98.

A bracket 102 having first and second spaced apart sides 104,106 and a base 108 connected to and extending between the first and second sides 104,106 is mounted on the frame 12. Specifically, the base 108 is connected to and between first and second spaced apart transversely oriented plate members 110,112 of the frame 12 by welding. The first and second plate members 110,112 are secured to the first and second frame support members 30,32 such as by welding and further stiffens the frame 12. Means 114 is provided for fastening the lifting mechanism housing 46 to the bracket 102. The means 114 includes a plurality of threaded fasteners 116 which are screwthreadably secured to the base 108 of bracket 102 in a conventional manner.

First and second guide assemblies 118,120 are provided for guiding the platform for elevational movement in substantially a straight line and maintain the platform at the aforementioned preselected attitude relative to the vehicle frame 12. The first and second guide assemblies 118,120 are of a construction sufficient for resisting twisting, tipping, and rotating forces which are applied to the platform and prevent these forces from being transferred to the lifting mechanism 44.

The first guide assembly 118 has a guide housing 122, a longitudinal guide axis 124, and a guide rod 126 slidably connected to the guide housing 122 and extensibly movable along the guide axis 124. The guide housing 122 is mounted on the frame 12 at the second end portion 24 of the frame 12, and the guide axis 124 is substantially perpendicular to the connecting surface 38 of the platform 34. The guide rod 126 has first and second end portions 128,130 and is connected at the first end portion 128 to the connecting surface 38 of the platform 34 at a first preselected location 132 on the connecting surface 38 spaced from said third location 66. A stop 131 in the form of a cylindrical disc is connected to the second end portion 130 of the guide rod 126 and limits the amount extension of guide rod 126. The guide housing 122 has first and second spaced apart flange end portions 134,136 defining opposite ends of the guide housing 122 and a tubular middle portion 138 extending between the flange end portions 134,136. The guide rod 126 extends through openings 140,142 in the first and second flange end portions 134,136, respectively, and is guided by bearings 144 and 146 disposed in openings 140,142, respectively. The bearings 144,146 are preferably bushings manufactured of a suitable material such as bronze or steel. The bearings 144,146 engage the guide rod 126 at spaced apart locations along the guide rod 126 and support the guide rod 126 for slidable linear movement along guide axis 124. The first and second flange end portions 134,136 are preferably cast members secured to the tube 138 in any suitable manner, such as by welding. Means 155 is provided for fastening the first and second flange end portions 134,136 of the first guide assembly 118 to the first side 104 of bracket 102. Preferably, means 155 includes mounting bosses 148 on the first and second flange end portions 134,136, apertures 150 disposed in the mounting bosses 148, and threaded fasteners 152. Preferably, each flange end portion 134,136 has a pair of mounting bosses 148 and is secured to the frame 12 by a pair of fasteners 152.

The second guide assembly 120 is identical in construction to that of the first guide assembly 118 and therefore will be discussed only briefly. It is to be noted that the component parts of the second guide assembly 120 discussed herein will be identified when shown by numbers which are identical to those of the first guide assembly 118 but with a prime added following the number.

The second guide assembly 120 has a guide housing 122', a longitudinal guide axis 124', and a guide rod 126' slidably connected to the guide housing 122' and extensibly movable along the guide axis 124'. The guide housing 122' is mounted on the frame 12 at the second end portion 18 of the frame 12, and the guide axis 124' is substantially perpendicular to the connecting surface 38 of the platform 34. The guide rod 126' has first and second end portions 128',130' and is connected at the first end portion 128' to the connecting surface 38 of the platform 34 at a second preselected location 154 on the connecting surface 38 spaced from said third location 66 and said first location 132. A stop 131' in the form of a cylindrical disc is connected to the second end portion 130' of the guide rod 126' and limits the amount extension of guide rod 126'. The guide housing 122' has first and second spaced apart flange end portions 134',136' defining opposite ends of the guide housing 122', and a tubular middle portion 138' extending between the flange end portions 134',136'. The guide rod 126 extends past the first and second flange end portions 134',136', respectively, and is guided in a manner identical to the first guide assembly 118 for slidable linear movement along guide axis 124'. The first and second flange end portions 134',136' are preferably cast members secured to the tube 138' in any suitable manner, such as by welding. Means 155 is additionally provided for fastening the first and second flange end portions 134',136' of the second guide assembly 120 to the second side 106 of bracket 102 Means 155 includes mounting bosses 148' on the first and second flange end portions 134',136', apertures 150' disposed in mounting bosses 148', and threaded fasteners 152'. Preferably, each flange end portion 134',136' has a pair of mounting bosses 148' and is secured to the frame 12 by a pair of fasteners 152'. Specifically, the threaded fasteners 152 secure the first and second flange end portions 134 and 136 of the first guide assembly 118 to the first side 104 of bracket 102, and the threaded fasteners 152 secure the first and second flange end portions 134',136' of the second guide assembly 120 to the second side 106 of bracket 102.

The guide axes 124,124' are substantially parallel to each other and substantially parallel to the axis 48 of the lifting mechanism 44. The axes 124,124' and 48 extend elevationally from the frame 12 and are preferably substantially perpendicular to an upper edge 156 (FIG. 1) of the frame 12. The guide axes 124,124' and the lifting axis 48 preferably lie along a common plane 158 which is normal to connecting surface 38. The first, second and third locations 132,154 and 66 are located along the line of intersection between the plane 158 and connecting surface 38 adjacent the points of intersection between the axes 124,124',48 and the connecting surface 38. The third location 66 is between the first and second locations 132,154 and preferably equidistant from the first and second locations 132,154.

A first means 160 is provided for connecting the first end portion 128 of the guide rod 126 of the first guide assembly 118 to the connecting surface 38 of platform 34 at the first location 132, and a second means 162 is provided for connecting the first end portion 128' of the guide rod 126' of the second guide assembly 120 to the connecting surface 38 of platform 34 at the second location 154. Since the first and second connecting means 160,162 are identical in construction, any reference to one of the connecting means will relate to the other. The detailed construction of the second connecting means 162 will be identified by the same reference numeral as the first connecting means 160 but with a prime added following the reference numeral.

The first and second connecting means 160,162 each include a sleeve 164,164' having a bore 166,166' and a first end portion 168,168'. The first end portion 168 of sleeve 164 is rigidly secured to the platform 34 at the first location 132 by a plurality of threaded fasteners 170 screwthreadably engaged with the sleeve 168, and the first end portion 168' of sleeve 164' is rigidly secured to the platform 34 at the second location 154 by a plurality of threaded fasteners 170' screwthreadably engaged with the sleeve 168'. The first end portion 128 of the guide rod 126 of the first guide assembly 118 is disposed in the bore 166, and the first end portion 128' of the guide rod 126' of the second guide assembly 120 is disposed in the bore 166'. The guide rods 126,126' are preferably welded to the sleeves 164,164'. By this construction, the rods 126,126' are securely connected to the platform 34 so that the forces tending to rotate, bend, and otherwise cause failure of the connections are resisted. Further, the two sleeves 164,164' will share the load and thus reduce the individual loading on the sleeves 164,164' and the first and second guide assemblies 118,120.

INDUSTRIAL APPLICABILITY

With reference to the drawings, and in operation, the vehicle 10 is movable about a factory, warehouse, and the like for transporting loads between storage and manufacturing locations. The load to be transported is placed upon the platform 34 in any suitable manner known to the material handling and machining industries such as by fork lifts, hoists, cranes, conveyors, and the like. Because of fluctuations in the size and shape of the load to be carried and the inaccurate ability of the loading equipment to accurately place the load, the load center of mass may be offset from the lifting axis 48. Thus, the weight of the load will tend to apply tipping forces to the platform 34 about the lifting axis 48. Since the lifting mechanism 44 is free from rigid connection with the connecting surface 38 of the platform 34, any loading of the platform 34 which tends to tip the platform will not be transferred to the shaft 50 of the lifting mechanism 44. Instead, the connecting surface 38 will pivot (roll) about the load bearing portion 62 of the bearing member 60.

The first and second guide assemblies 118,120 further enhance the trouble free operation of the lifting mechanism 14 by resisting pivotal movement of the platform 34 and limiting the amount of pivotal movement to substantially none. This is achieved because the guide rods 126,126' of the first and second guide assemblies 118,120 are substantially parallel to each other and guided by the bearings 144,146 for linear movement only. The first and second connecting means 160,162 further restrict any pivotal movement of the platform 34 by providing a rigid stiff connection between the platform 34 and the guide rods 126,126'.

During the loading/unloading operation of the vehicle 10, there is the potential for forces to be applied to the platform 34 which tend to rotate the platform 34 about the lifting axis 48. Also, impact between an external object and the platform 34 during the normal vehicle work cycle may occur which would tend to rotate the platform 48 about the lifting axis 48. To relieve the lifting mechanism 44 from being exposed to these rotary forces which would be detrimental to the life and operation of the elevating device 14, the aforementioned bearing member 60 and engaging means 68 were provided. These, however, do not maintain the platform at the desired rotated attitude relative to the frame 12. The first and second guide assemblies 118,120 achieve the desired stability required and prevent platform 34 rotation. Because the guide assemblies 118,120 are positioned and spaced in the manner aforementioned, the forces of rotation placed on the platform 34 are equally shared by the guide assemblies 118,120.

The lifting mechanism 44, as a result of the aforementioned construction, is free from damaging tipping and rotary forces. As a result, the size and strength of the lifting mechnanism 44 is substantially reduced over traditional devices since it supports only forces acting axially along the lifting axis 48. This compactness permits usage in applications where space is limited and conventional elevating devices were not suitable due to their size limitations.

The power means 86 responds to the controller 100 and moves the shaft 50 of the lifting mechanism 44 in directions between first and second positions 56 and 58. The controller 100 responds to preprogrammed instructions contained therein and moves the shaft 50 to place the platform 34 at the desired elevational location at or between the lowered and raised positions 88,90 of the platform 34. The elevated position desired is determined by the particular circumstances of the material handling operation at hand. The guide assemblies 118,120 provide free smooth movement of the platform 34 throughout the full range of elevational movement and maintains the platform 34 at the preselected attitude relative to the frame 12 so that the lifting mechanism is subjected to only linear forces acting along lifting axis 48. Because the axes 124,124' are maintained substantially parallel to each other and the lifting axis 48, this free smooth elevational movement is provided throughout the length of stroke of the guide rods 126,126' and the shaft 50.

Other aspects, objects and advantages of this invention can be obtained from a study of the drawings, the disclosure and the appended claims.

I claim:

1. A work vehicle, comprising:

a vehicle frame;

a platform having opposed load engaging and connecting surfaces;

a lifting mechanism having a housing, a lifting axis, and a shaft movably connected to the housing, said housing being connected to said frame, and said shaft having a first end portion and being movable relative to said housing along said lifting axis between first and second spaced apart positions;

a first guide assembly having a guide housing, a guide axis, and a guide rod slidably connected to said guide housing and movable along said guide axis, said guide rod having a first end portion connected to said connecting surface at a first location on the connecting surface and said guide housing being connected to the frame;

a second guide assembly having a guide housing, a guide axis, and a guide rod slidably connected to said second guide assembly guide housing and movable along the second guide assembly guide axis, said second guide assembly guide rod having a first end portion connected to the connecting surface at a second location on the connecting surface spaced from the first location, said first guide assembly guide housing being connected to the frame;

a bearing member having a load bearing portion and being connected to the shaft first end portion, said load bearing portion being engaged with said connecting surface at a third location on the connecting surface spaced from said first and second locations; and means for engaging said bearing member and maintaining said bearing member at said third location on the connecting surface, said engaging means having a flange portion and said flange portion being spaced a preselected distance from said bearing member, in a direction along said lifting axis, when said bearing member is engaged with the connecting surface, said bearing member being free to roll relative to said connecting surface an amount determined by said preselected distance between the flange portion and bearing member.

2. A work vehicle, as set forth in claim 1, wherein said bearing member has a retaining portion opposite the load bearing portion, said retaining portion being connected to the shaft first end portion, and said load bearing portion having a crowned spherically shaped profile.

3. A work vehicle, comprising:

a vehicle frame;

a platform having opposed load engaging and connecting surfaces;

a lifting mechanism having a housing, a lifting axis, and a shaft movably connected to the housing, said housing being connected to said frame, and said shaft having a first end portion and being movable relative to said housing along said lifting axis between first and second spaced apart positions;

a first guide assembly having a guide housing, a guide axis, and a guide rod slidably connected to said guide housing and movable along said guide axis, said guide rod having a first end portion connected to said connecting surface at a first location on the connecting surface and said guide housing being connected to the frame;

a second guide assembly having a guide housing, a guide axis, and a guide rod slidably connected to said second guide assembly guide housing and movable along the second guide assembly guide axis, said second guide assembly guide rod having a first end portion connected to the connecting surface at a second location on the connecting surface spaced from the first location, said first guide assembly guide housing being connected to the frame;

a bearing member having a load bearing portion and a retaining portion opposite the load bearing portion, said retaining portion being connected to the shaft first end portion and said load bearing portion having a crowned spherically shaped profile, said load bearing portion being engaged with said connecting surface at a third location on the connecting surface spaced from said first and second locations; and means for engaging said bearing member and maintaining said bearing member at said third location on the connecting surface, said engaging means having a connector, said connector having a shank portion and a flange portion connected to and extending from said shank portion, said shank portion being connected to said platform connecting surface at a location on said platform connecting surface adjacent said third location and said flange portion being engageable with said retaining portion.

4. A work vehicle, as set forth in claim 3, wherein said shank portion has a bore and a counterbore disposed therein, said flange portion having an annular ring shaped configuration and being disposed in and extending radially inwardly from the counterbore.

5. A work vehicle, comprising:

a vehicle frame;

a platform having opposed load engaging and connecting surfaces;

a lifting mechanism having a housing, a lifting axis, and a shaft movably connected to the housing, said housing being connected to said frame, and said shaft having a first end portion and being movable relative to said housing along said lifting axis between first and second spaced apart positions;

a first guide assembly having a guide housing, a guide axis, and a guide rod slidably connected to said guide housing and movable along said guide axis, said guide rod having a first end portion connected to said connecting surface at a first location on the connecting surface and said guide housing being connected to the frame;

a second guide assembly having a guide housing, a guide axis, and a guide rod slidably connected to said second guide assembly guide housing and movable along the second guide assembly guide axis, said second guide assembly guide rod having a first end portion connected to the connecting surface at a second location on the connecting surface spaced from the first location, said first guide assembly guide housing being connected to the frame;

first means for connecting the first end portion of the first guide assembly guide rod to the platform connecting surface at said first location, said first connecting means having a sleeve, said sleeve having a bore and a first end portion, said first end portion of the sleeve being rigidly attached to the platform at said first location and said first end portion of said first guide assembly guide rod being disposed in the bore of said sleeve;

second means for connecting the first end portion of the second guide assembly guide rod to the platform connecting surface at said second location, said second connecting means having a sleeve, said sleeve of the second connecting means having a bore and a first end portion, said first end portion of the sleeve of the second connecting means being rigidly attached to the platform at said second location and said first end portion of the second guide assembly guide rod being disposed in the bore of the sleeve of the second connecting means;

a bearing member having a load bearing portion and being connected to the shaft first end portion, said load bearing portion being engaged with said connecting surface at a third location on the connecting surface spaced from said first and second locations; and means for engaging said bearing member and maintaining said bearing member at said third location on the connecting surface.

6. A work vehicle, as set forth in claim 5, wherein the guide axis of the first guide assembly is substantially parallel to the guide axis of the second guide assembly.

7. A work vehicle, as set forth in claim 6, wherein the third location on the connecting surface is between the first and second locations, and said lifting axis is substantially parallel to the guide axes of the first and second guide assemblies.

8. A work vehicle, comprising:

a vehicle frame;

a platform having opposed load engaging and connecting surfaces;

a lifting mechanism having a housing, a lifting axis, and a shaft movably connected to the housing, said housing being connected to said frame, and said shaft having a first end portion and being movable relative to said housing along said lifting axis between first and second spaced apart positions;

a first guide assembly having a guide housing, a guide axis, and a guide rod slidably connected to said guide housing and movable along said guide axis, said guide rod having a first end portion connected to said connecting surface at a first location on the connecting surface and said guide housing being connected to the frame;

a second guide assembly having a guide housing, a guide axis, and a guide rod slidably connected to said second guide assembly guide housing and movable along the second guide assembly guide axis, said second guide assembly guide rod having a first end portion connected to the connecting surface at a second location on the connecting surface spaced from the first location, said first guide assembly guide housing being connected to the frame;

a bearing member having a load bearing portion and being connected to the shaft first end portion, said load bearing portion being engaged with said connecting surface at a third location on the connecting surface spaced from said first and second locations;

means for engaging said bearing member and maintaining said bearing member at said third location on the connecting surface;

a bracket having first and second spaced apart sides and a base connected to and between said first and second sides, said guide housings of the first and second guide assemblies each having first and second spaced apart flange end portions; and means for fastening the first and second flange end portions of the first guide assembly guide housing to the first side and for fastening the first and second flange end portions of the second guide assembly guide housing to the second side.

9. A work vehicle, as set forth in claim 8, including:

power means for moving said shaft between said first and second spaced apart positions, said power means being connected to the housing of said lifting mechanism; and means for fastening the housing of said lifting mechanism to said bracket.

10. An automatic guided vehicle, comprising:

a frame;

a platform having opposed load engaging and connecting surfaces;

a lifting mechanism having a housing, a lifting axis, and a shaft movably connected to the housing, said housing being connected to said frame, and said shaft having a first end portion and being movable relative to said housing along said lifting axis between first and second apaced apart positions;

power means for moving said shaft between said first and second spaced apart positions;

a first guide assembly having a guide housing, a guide axis, and a guide rod slidably connected to said guide housing, said guide rod having a first end portion and being movable along said guide axis, said guide housing being connected to the frame;

first means for connecting the guide rod first end portion to the connecting surface of the platform at a first location on the connecting surface;

a second guide assembly having a guide housing, a guide axis and a guide rod slidably connected to said second guide assembly guide housing, said second guide assembly guide rod having a first end portion and being movable along the second guide assembly guide axis, said second guide assembly guide housing being connected to the frame;

second means for connecting the second guide assembly guide rod first end portion to the connecting surface of the platform at a second location on the connecting surface spaced from the first location, said lifting mechanism lifting axis being substantially parallel to the guide axes of the first and second guide assemblies;

a bearing member having a load bearing portion, a retaining portion, and being connected at the retaining portion to the shaft first end portion, said load bearing portion having a spherically crowned profile and being engaged with said connecting surface at a third location on the connecting surface spaced from and between said first and second locations; and a connector having a shank portion and a flange portion connected to and extending from the shank portion, said shank portion being mounted on the connecting surface adjacent said third location and said flange portion being engageable with the retaining portion.

11. An automatic guided vehicle, as set forth in claim 10, wherein said shank portion has a bore and a counterbore disposed therein, said flange portion having an annular ring shaped configuration and being disposed in and extending radially inwardly from the counterbore.

12. An automatic guided vehicle, as set forth in claim 10, wherein said first connecting means includes a sleeve having a bore and a first end portion, said first end portion of the sleeve being rigidly attached to the platform at said first location, and said first end portion of said first guide assembly guide rod being disposed in the bore of said sleeve, said second connecting means includes a sleeve having a bore and a first end portion, said first end portion of the sleeve of the second connecting means being rigidly attached to the platform at said second location and said first end portion of the second guide assembly guide rod being disposed in the bore of the sleeve of the second connecting means.

13. An automatic guided vehicle, as set forth in claim 10, wherein said power means includes an electric motor mounted on said lifting mechanism housing and drivingly connected to said shaft.

14. An automatic guided vehicle, as set forth in claim 13, including:

a bracket having first and second spaced apart sides, and a base connected to and between said first and second sides, said bracket being mounted on said frame and said lifting mechanism housing being connected to said base; and means for fastening the first guide assembly housing to said bracket first side and the second guide assembly housing to the second side.

* * * * *